United States Patent [19]

Toland

[11] Patent Number: 5,011,084

[45] Date of Patent: Apr. 30, 1991

[54] GARDEN HOSE SPOUT

[76] Inventor: Jonathan S. Toland, Rte. 1, Box 244A, Cornelius, Oreg. 97113

[21] Appl. No.: 404,844

[22] Filed: Sep. 7, 1989

[51] Int. Cl.[5] ..... B05B 9/00

[52] U.S. Cl. ..... 239/602; 239/546; 239/DIG. 12

[58] Field of Search ..... 239/546, 602, 533.12, 239/DIG. 12; 222/78, 183

[56] References Cited

U.S. PATENT DOCUMENTS

| | | | |
|---|---|---|---|
| 1,072,951 | 9/1913 | Johnston | 239/546 |
| 1,327,452 | 1/1920 | Williams | 239/546 |
| 1,865,012 | 6/1932 | Jackson | 239/546 |
| 2,014,708 | 9/1935 | Vawter | 239/546 |
| 2,593,420 | 4/1952 | Diehl | 239/546 |
| 2,959,359 | 11/1960 | Casaletto | 239/546 |
| 3,027,098 | 3/1962 | Helmer | 239/602 |
| 3,254,969 | 6/1966 | Easey | 239/546 |
| 3,848,808 | 11/1974 | Fetty et al. | 239/546 |

FOREIGN PATENT DOCUMENTS

| | | | |
|---|---|---|---|
| 1309901 | 10/1961 | France | 239/533.13 |
| 904593 | 2/1982 | U.S.S.R. | 239/546 |
| 196960 | 5/1923 | United Kingdom | 239/533.13 |

*Primary Examiner*—Andres Kashnikow
*Assistant Examiner*—Christopher G. Trainor
*Attorney, Agent, or Firm*—Klarquist, Sparkman, Campbell, Leigh & Whinston

[57] ABSTRACT

A garden hose spout having a hand compressible bellowed conduit provides convenient and precise control over water flow.

14 Claims, 3 Drawing Sheets

GARDEN HOSE SPOUT

BACKGROUND OF THE INVENTION

The present invention relates generally to gardening apparatus and particularly to a garden hose spout.

Garden hose spouts, or nozzles, differ in cost, complexity and capability. A common garden hose nozzle is a spray gun which attaches to a garden hose and includes a handle and opposing trigger. A user grasps the handle and moves the trigger with one hand to control the volume and spray pattern of water exiting the nozzle. This form of garden hose nozzle provides convenient control, but necessarily includes mechanisms for coupling the trigger to a valve and structural elements forming the handle and trigger. These features contribute to manufacturing cost and complexity of the device.

A second type of garden hose nozzle has an outer sleeve which rotates to control the volume and spray pattern of water exiting the nozzle. The operator uses both hands to control the sleeve type nozzle. The sleeve type nozzle is less complex, but also less convenient than the spray gun type.

A third type of nozzle is a perforated can connectable to a garden hose. Water enters the can from the hose and escapes through the perforations in a multi-stream spray pattern. While simple and inexpensive to produce, the can-type garden hose nozzle offers little control over water flow.

A fourth type of garden hose nozzle is a rigid cone shaped conduit providing a small volume, high velocity output stream with no volume or spray pattern adjustability.

Thus, complex relatively expensive garden hose nozzles provide convenient control over water flow. Less complex, less expensive garden hose nozzles do not provide convenient control. Accordingly, it is desirable for a less complex or less expensive garden hose nozzle to provide convenient and precise control over water flow.

SUMMARY OF THE INVENTION

A hand operated spout attaches to a common garden hose having an externally threaded outlet end. The spout includes a conduit with portions adapted for compression by pinching or hand gripping action. An adapter couples a first end of the conduit to the outlet of the hose. Water provided at the hose outlet passes from the first end of the conduit to a second end of the conduit. Water exits the second end of the conduit in a concentrated stream having a volume and spray pattern influenced by gripping action exerted upon the conduit.

In a preferred embodiment of the invention, the spout is a unitary cast body formed by plastic injection molding. The cost for each spout is low compared to other garden hose spouts, yet the spout provides more convenient control over water flow. The conduit is a bellowed conduit with upper and lower plate elements interconnected by folding side elements. A user grasps the spout with the plate elements between thumb and index finger and applies pinching action to influence the spray pattern of water exiting the spout.

In alternative embodiments, a valve within the adapter permits the user to stop the flow of water without turning off the water faucet, or a ratchet mechanism permits the user to releasably set the conduit to a predetermined amount of compression.

It is an object of the present invention to provide an inexpensive, yet effective spout for a garden hose which enables the operator to conveniently control the water volume and spray pattern with precision.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION OF THE PREFERRED EMBODIMENT

Figure 1:
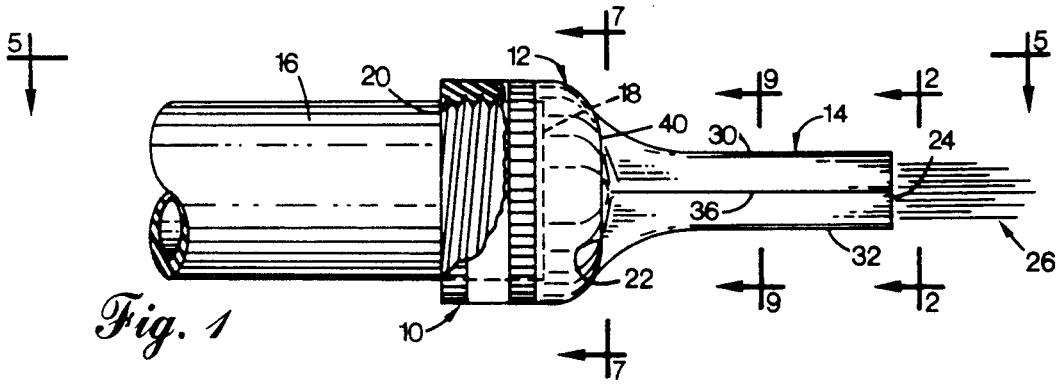
FIG. 1 is a side view of a garden hose spout, according to the present invention, shown in an open position.

In FIG. 1, a hand held garden hose spout 10 according a specific embodiment of the present invention includes an adapter 12 and a collapsible bellowed conduit 14. Garden hose 16 has an externally threaded end 18. Adapter 12 includes an internally threaded portion 20 for coupling to end 18 of hose 16. Garden hose 16 connects to a water faucet at an end (not shown) opposite of end 18 and provides water to adapter 12. Conduit 14 includes an input end 22 connected to adapter 12 to receive the flow of water. Water exits output end 24 of conduit 14 in a spray 26.

Figure 3:
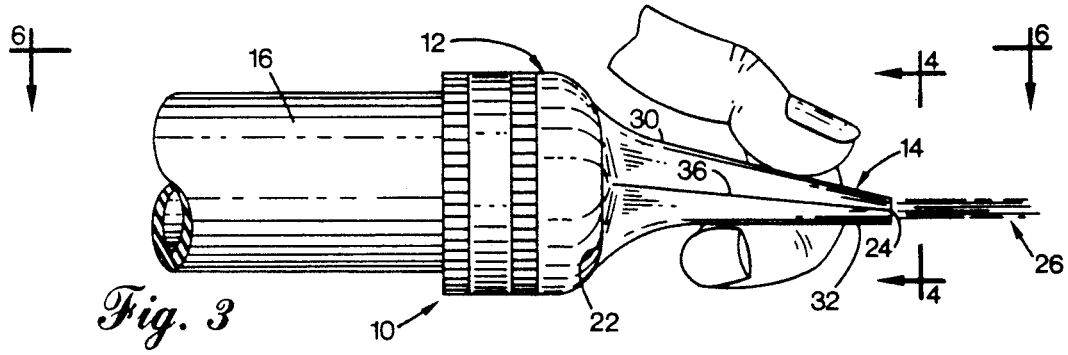
FIG. 3 is a side view of the garden hose spout of FIG. 1, shown in a collapsed position.
Figure 5:
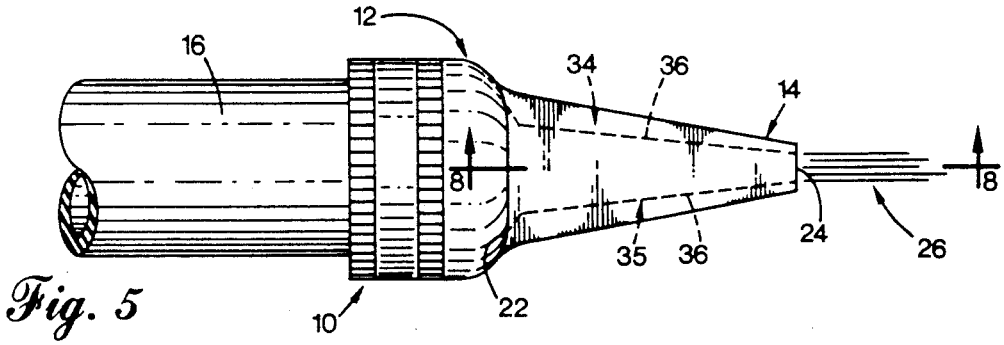
FIG. 5 is a top view of the garden hose spout of FIG. 1, taken along lines 5—5 of FIG. 1.
Figure 6:
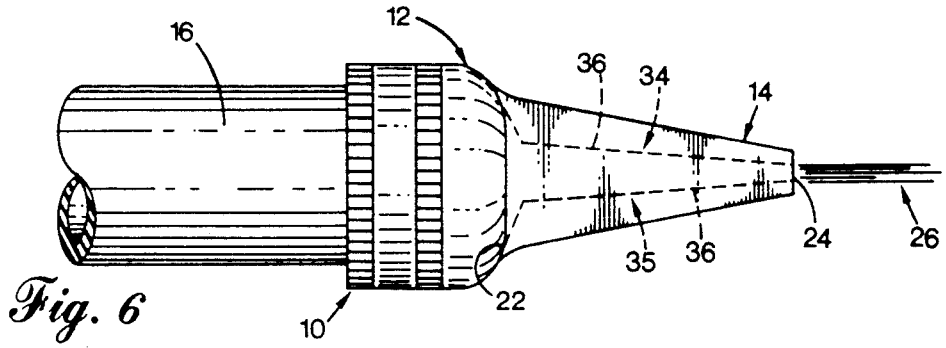
FIG. 6 is a top view of the garden hose spout of FIG. 3, taken along lines 6—6 of FIG. 3.
Figure 2:
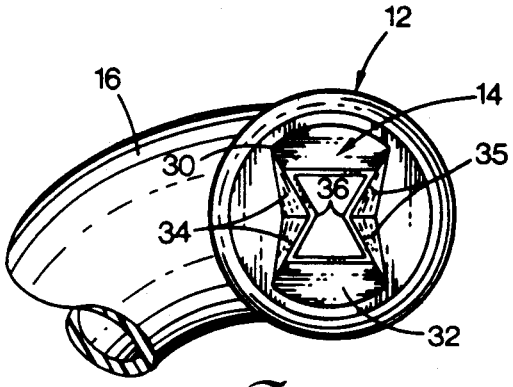
FIG. 2 is an end view of the garden hose spout of FIG. 1, taken along lines 2—2 of FIG. 1.
Figure 4:
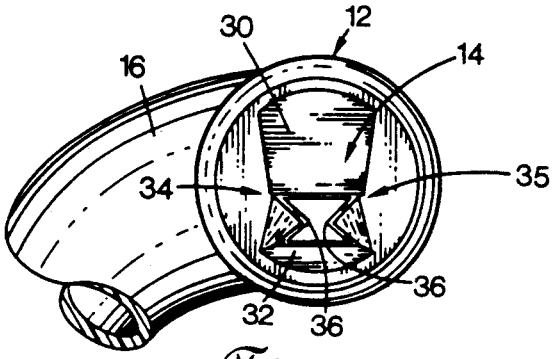
FIG. 4 is an end view of the garden hose spout of FIG. 3, taken along lines 4—4 of FIG. 3.

Conduit 14 moves freely between an open position, shown in FIGS. 1, 2 and 5, and a collapsed position, shown in FIGS. 3, 4 and 6. Water flowing through conduit 14 biases conduit 14 toward its open position. By holding spout 10 between the thumb and index finger, as shown in FIG. 3, an operator of spout 10 influences the volume and shape of spray 26. Exerting gripping action on conduit 14 moves conduit 14 toward its collapsed position. When spout 10 is in its collapsed position, spray 26 is thin and concentrated (FIGS. 3 and 6). In its open position, spout 10 produces a more solid, higher volume spray 26 (FIGS. 1 and 5). By controllably applying pinching action on conduit 14, spray 26 exits spout 10 in patterns intermediate of those shown in FIGS. 1, 3, 5 and 6.

In the preferred embodiment of the present invention, conduit 14 is a bellowed conduit having a hinged rigid upper plate 30 and a rigid lower plate 32. Right side section 34 and left side section 35 are flexible and interconnect plates 30 and 32 to form a collapsible conduit. Plate 30 attaches to adapter 12 in substantially hinged fashion and approaches plate 32. Sections 34 and 35 each include a single inwardly directed longitudinal fold 36.

As best seen in FIGS. 5 and 6, plates 30 and 32 taper laterally inward from end 22 to end 24 for increasing the velocity of spray 26 relative to the velocity of water introduced into adapter 12 from hose 16. Further increase in velocity is achieved when spout 10 moves from its open position to its collapsed position.

Figure 7:
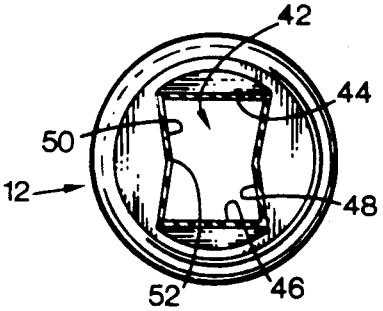
FIG. 7 is a sectional view of an adapter portion of the spout of FIG. 1, taken along lines 7—7 of FIG.1.

FIG. 7 illustrates the interface between adapter 12 and conduit 14. The outlet end 40 of adapter 12 is an aperture 42 having substantially flat upper and lower edges 44 and 46, respectively. Upper and lower edges 44 and 46 connect by way of left side edge 48 and right side edge 50. Each of side edges 48 and 50 comprise two inwardly converging substantially flat surfaces. The overall cross-sectional shape of aperture 42 is a polygonal hourglass shape as seen in FIG. 7. Upper plate 30 attaches hingedly to edge 44 of aperture 42 while lower plate 32 attaches to edge 46 of aperture 42. Right side section 34 attaches along edge 50 of aperture 42. The groin point 52, at which the converging surfaces of edge 50 meet, defines the fold 36 in right side section 34. Left side section 35 attaches in similar fashion to edge 48 of aperture 42. Aperture 42 thereby maintains the inlet end 22 of conduit 14 in an open condition with a substantially hourglass cross-sectional shape to maintain folds 36 in an inward direction.

Figure 8:
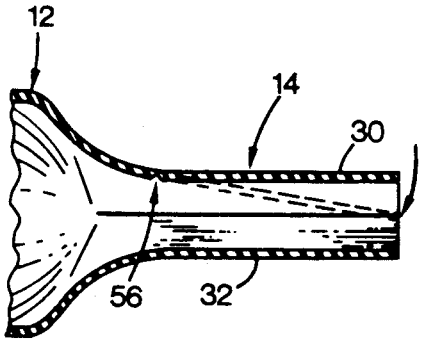
FIG. 8 is a sectional view of the spout of FIG. 5, taken along lines 8—8 of FIG. 5, illustrating a hinged upper plate of the spout.

FIG. 8 illustrates the hinged connection between upper plate 30 and adaptor 12. In forming the spout 10, a groove 56 is formed at the interface between plate 30 and adaptor 12. The groove 56 would extend laterally across the entire width of plate 30 to provide a region of lesser thickness at which plate 30 pivots relative to adaptor 12. Lower plate 32 would be of substantially the same thickness as the lower portion of adaptor 12 and thereby form a base platform. With the plate 32 resting against the index finger and the thumb resting against the upper plate 30, as shown in FIG. 3, the only substantially moving part would be upper plate 30 and the user would be able to accurately position upper plate 30 relative to lower plate 32 in order to precisely control the flow of water exiting spout 10.

Figure 9:
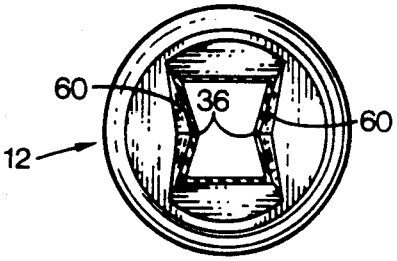
FIG. 9 is a sectional view of the spout, taken along lines 9—9 of FIG. 1, illustrating structural fortification of the spout.

In FIG. 9, portions 60 of side sections 34 and 35 near folds 36 include additional fortification or thickness. Without such fortification, the force of water through conduit 14 tends to splay outward side elements 34 and 35 and when the user grips and closes conduit 14, conduit 14 may not collapse with folds 36 directed inward. Additional fortification is a preferred solution to this problem. The additional fortification at folds 36 extends through the length of conduit 14 and serves to maintain folds 36 in a slightly inward orientation when spout 10 is in its open position with water flowing through spout 10. When the user applies pinching action to conduit 14, side sections 34 and 35 are predisposed to fold inward. The desired configuration of conduit 14 for suitably controlling the volume and shape of spray 26 is thereby achieved.

Figure 10:
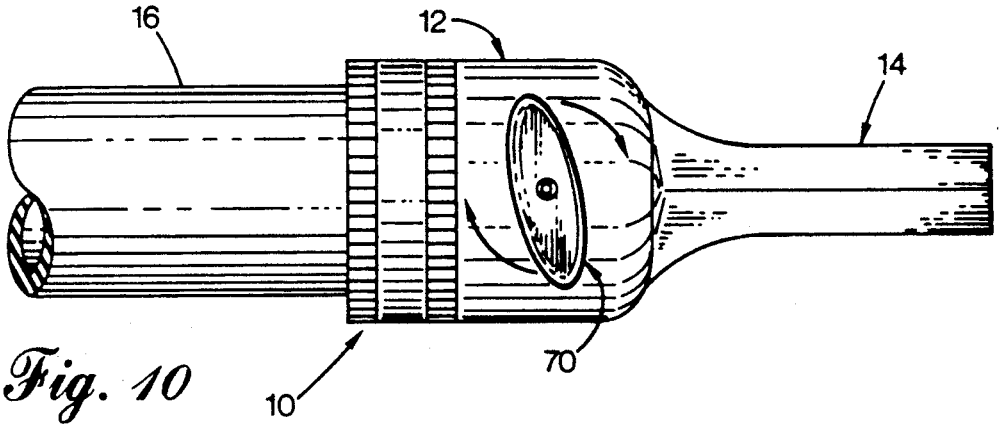
FIGS. 10–12 illustrate alternative embodiments of the present invention.

An additional feature which may be easily incorporated into spout 10 is shown in FIG. 10. In FIG. 10, a valve 70 is included within adapter 12. Valve 70 selectively stops the flow of water from adapter !2 to conduit 14. A user of spout 10 then turns on valve 70 when spout 10 is to be used and turns off valve 70 when spout 10 is temporally not used. Valve 70 saves the trouble of shutting off the water faucet which may be some distance from the site of use. Also, if spout 70 is taken out of service for an extended period of time, valve 70 saves water which would otherwise be wasted.

Figure 11:
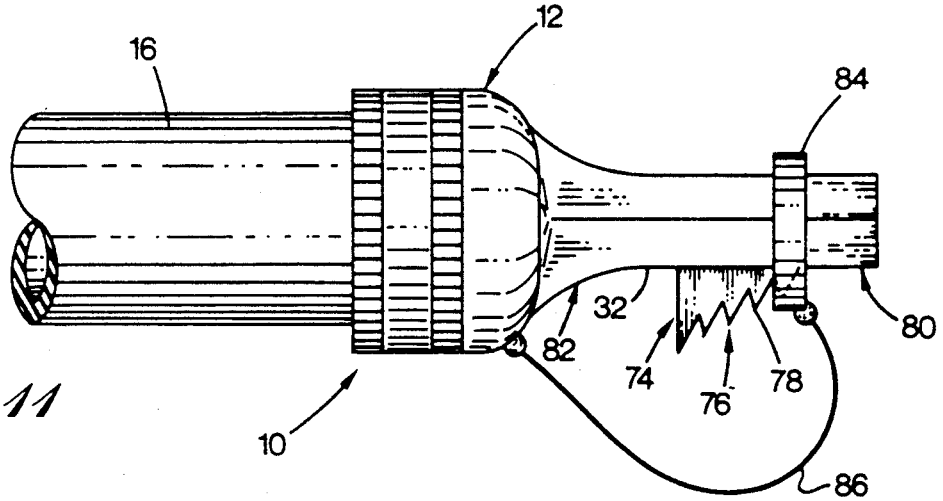

Spout 10 may also be provided with a ratchet mechanism for permitting the user to releasably set the conduit 14 at a predetermined amount of compression. The ratchet mechanism then relieves the user of the task of maintaining pressure against upper plate 30 to provide a given, precise and maintained, spray pattern 26. FIG. 11 illustrates a first form of the ratchet mechanism. In FIG. 11, the under surface of lower plate 32 includes a ramp formation 74. The ramp formation 74 has an inclined surface 76 having ratchet teeth 78. Surface 76 tapers away from plate 32 from the forward portion 80 of plate 3 toward the rear portion 82 of plate 32. A ring 84 surrounds conduit 14 and is dimensioned to closely surround conduit 14 when conduit 14 is in its open position. As ring 84 is moved back toward adaptor 12, ring 84 rides along the inclined surface 76 and causes upper plate 30 to move toward lower plate 32. Ring 84 is adapted to engage the teeth 78 of ramp 74 in order to catch teeth 76 and maintain its position on conduit 14. Thus, by selectively moving ring 84 along conduit 14, a user may establish a particular spray pattern 26 without constantly exerting pressure against plate 30. It may be appreciated that ring 84 is easily dislocated from conduit 14 by squeezing conduit 14 to its fully-closed position and knocking ring 84 off with the thumb. A ratchet strap 86, connecting ring 84 and adapter 12, prevents loss of ring 84 when not in use. Thus, the ratchet mechanism shown in FIG. 11 is a quick release mechanism which allows the user to establish a preset position for conduit 14, yet quickly release the ring 84 in order to return to normal operation of spout 10.

Figure 12:
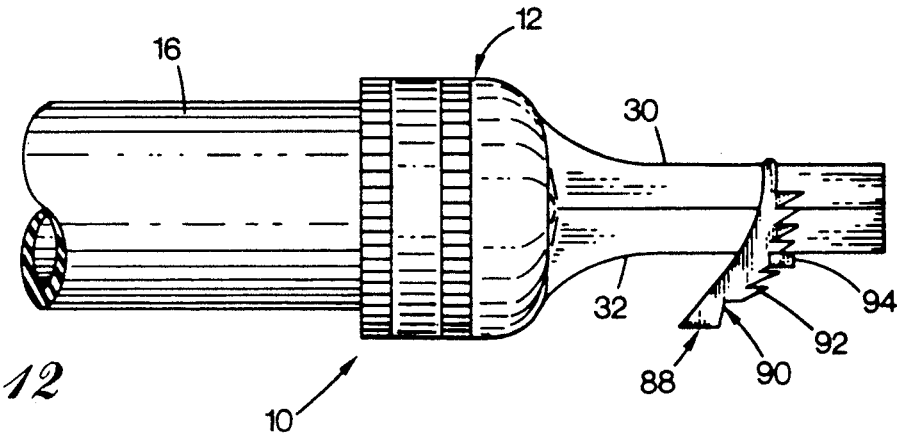

FIG. 12 shows a second ratchet mechanism which may also be used to establish a preset position for conduit 14 and permit quick release of the preset position. In FIG. 12, an arched release trigger 88 attaches to upper plate 30 and extends downward past lower plate 32 and toward adaptor 12. The forward edge 90 of trigger 88 includes ratchet teeth 92. A catch mechanism 94, attached to lower plate 32, is positioned adjacent teeth 92 to engage teeth 32 as upper plate 30 is moved toward lower plate 32. A second similar configuration may be attached to the opposite side of plate 30 to operate in unison with the trigger 88 shown in FIG. 12. In operation, the user may pinch conduit 14 to move plate 30 towards plate 32 and as plate 30 moves towards plate 32, mechanism 94 engages teeth 92 of trigger 88 and prevents plate 30 from moving back towards its open position. In this manner, a preset position for plate 30 is achieved. When the user wishes to quick release plate 30 from its predetermined position, trigger 88 is moved back towards adaptor 12 with the index finger and teeth 92 are moved out of mechanism 94. Plate 30 is then free to move upward toward its open position. Trigger 88 may be flexible enough to move it out away from mechanism 94 such that it rests on the outside edge of mechanism 94 in order to allow plate 30 to move freely as described herein above.

Thus, an inexpensive yet effective garden hose spout has been shown and described. The spout can be manufactured and marketed at low cost yet provides precise control over a strong spray of water exiting the spout.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A hand operated spout for a fluid carrying hose having an outlet, the spout comprising:

a conduit having a first end and a second end, said conduit comprising a pair of opposed rigid plates, said plates being interconnected by flexible side sections and;

adapter means for coupling the first end of said conduit to the outlet of said hose, at least one of said opposed rigid plates being hingedly attached at said first end of said conduit to said adapter means, said rigid plates being freely movable between an open position and a closed position at said second end of said conduit by hand gripping action, whereby fluid provided at the outlet of said hose passes from the first end of said conduit to the second end of said conduit and exists the spout in a stream having an intensity, volume and spray pattern influenced by said gripping action exerted upon said conduit.

2. A hand operated spout according to claim 1 wherein said conduit tapers laterally inward from the first end to the second end.

3. A hand operated spout according to claim 1 wherein said conduit is a bellowed conduit, said side sections having inwardly directed longitudinal folds.

4. A hand operated spout according to claim 1 wherein said spout is a unitary body formed by plastic injection molding.

5. A hand operated spout according to claim 1 wherein said adapter means comprises a shut-off valve.

6. A hand operated spout according to claim 1 further comprising ratchet means attached to at least one of said plates and means releasably engageable with said ratchet means to secure said plates in a desired relative position.

7. A hand operated spout for a fluid carrying hose having an outlet the spout comprising:

a conduit having a first end and a second end, portions of said conduit being freely movable between an open position and a closed position by hand gripping action; and adapter means for coupling the first end of said conduit to the outlet of said hose whereby fluid provided at the outlet of said hose passes from the first end of said conduit to the second end of said conduit and exits the spout in a stream having an intensity volume and spray pattern influenced by gripping action exerted upon said conduit, said conduit being a bellowed conduit comprising:

an upper plate having first and second end edges and first and second side edges, said upper plate being substantially rigid, said first end edge of said upper plate being hingedly coupled to said adapter means;

a lower plate having first and second end edges and first and second side edges, said lower plate being substantially rigid, said first end edge of said lower plate being coupled to said adapter mans;

a first inwardly folded flexible side section coupling said first side edge of said upper plate and said first side edge of said lower plate; and a second inwardly folded flexible side section coupling said second side edge of said upper plate and said second side edge of said lower plate, said first end edge of said upper plate and said first end edge of said lower plate comprising said first end of said conduit, and said second end edge of said upper plate and said second end edge of said lower plate comprising said second end of said conduit.

8. In combination, a garden hose and a spray spout therefor, the garden hose having an externally threaded outlet end providing a water source, the spray spout comprising:

an internally threaded adapter threadably connectable to the externally threaded outlet end of said hose to receive water from said hose; and a conduit having a first end and a second end, the first end being connected to said adapter to receive water, said conduit comprising a pair of opposed rigid plates, the plates being interconnected by flexible side sections, at least one of said plates being hingedly attached to said adapter at the first end of the conduit, the second end of the conduit being open, whereby the second end of the conduit is freely compressible by hand pinching action to influence the spray pattern of water exiting the second end of said conduit.

9. A combination according to claim 8 wherein said conduit tapers laterally inward from the first end to the second end.

10. A combination according to claim 8 wherein said conduit is a bellowed conduit.

11. In combination, a garden hose and a spray spout therefor, the garden hose having an externally threaded outlet end providing a water source, the spray spout comprising:

an internally threaded adapter threadably connectable to the externally threaded outlet end of said hose to receive water from said hose; and a conduit having a first end and a second end, the first end being connected to said adapter to receive water, the second end being open and freely compressible by hand pinching action to influence the spray pattern of water exiting the second end of said conduit, said conduit being a bellowed conduit comprising:

a rigid upper plate having first and second end edges and first and second side edges;

a rigid lower plate having first and second end edges and first and second side edges;

a first inwardly folded side section coupling said first side edge of said upper plate and said first side edge of said lower plate; and a second inwardly folded side section coupling said second side edge of said upper plate and said second side edge of said lower plate, said first end edge of said upper plate and said first end edge of said lower plate comprising said first end of said conduit, and said second end edge of said upper plate and said second end edge of said lower plate comprising said second end of said conduit.

12. A spout attachment for an externally threaded outlet end of a garden hose providing a source of water, the spray spout comprising:

an adapter having a first end and a second end, the first end being internally threaded for connection to the outlet end of the garden hose to receive water from the garden hose and deliver water to the second end of said adapter;

a first rigid plate element having first and second end edges and first and second side edges, the first end edge of said first rigid plate element being hingedly attached to the second end of said adapter;

a second rigid plate element having first and second end edges and first and second side edges, the first end edge of said second rigid plate element being rigidly attached to the second end of said adapter;

a first inwardly folded flexible side section having first and second end edges and first and second side edges, the first side edge of said first inwardly folded flexible side section being attached to the first side edge of said first rigid plate element, the second side edge of said first inwardly folded flexible side section being attached to the first side edge of said second rigid plate element, the first end edge of said first inwardly folded flexible side element being attached to the second end of said adapter; and a second inwardly folded flexible side element having first and second end edges and first and second side edges, the first side edge of said second inwardly folded flexible side section being attached to the second side edge of said first plate element, the second side edge of said second inwardly folded flexible side section being attached to the second side edge of said second rigid plate element, the first end edge of said second inwardly folded flexible side section being attached to the second end of said adapter, said first and second rigid plate elements together with said first and second inwardly folded flexible side sections being cooperative to form a hand compressible bellowed conduit for carrying water from the second end of said adapter to an outlet end of said bellowed conduit formed by the second end edges of said first and second rigid plate elements and the second end edges of said first and second inwardly folded side sections.

13. The spout according to claim 12 wherein the spout is a unitary body formed by plastic injection molding.

14. The spout according to claim 12 wherein the second end of said adapter comprises an hourglass shaped aperture having substantially flat upper and lower edges interconnected by first and second side edges, each of said first and second side edges comprising two substantially flat inwardly converging surfaces, the first end edge of said first rigid plate element being hingedly connected to the upper edge of said aperture, the first end edge of said second rigid plate element being connected to the lower edge of said aperture, said first inwardly folded flexible side section being connected to the first side edge of said aperture, with an inwardly directed fold of said first side section coincident with the point of convergence of the inwardly converging surfaces of said first side edge, said second inwardly folded side section being connected to the second side edge of said aperture, with an inwardly directed fold at said second side section coincident with the point of convergence of the inwardly converging surfaces of said second side edge.

* * * * *